US005428328A

United States Patent [19]

Haase et al.

[11] Patent Number: 5,428,328

[45] Date of Patent: Jun. 27, 1995

[54] MID TERMINAL FOR A DOUBLE BREAK CIRCUIT BREAKER

[75] Inventors: Donald H. Haase; Randall L. Siebels, both of Cedar Rapids, Iowa; James V. Fixemer, Denton; Fred Kaveh, Lincoln, both of Nebr.

[73] Assignee: Square D Company, Palatine, Ill.

[21] Appl. No.: 181,277

[22] Filed: Jan. 13, 1994

[51] Int. Cl.[6] ..... H01H 75/00

[52] U.S. Cl. ..... 335/16; 335/201; 335/202; 218/1

[58] Field of Search ..... 335/16, 147, 195, 201, 335/202; 200/144 R, 147 R

[56] References Cited

U.S. PATENT DOCUMENTS 4,325,041 4/1982 Murai ..... 335/16

5,159,304 10/1992 Yamagata et al. ..... 335/202

*Primary Examiner*—Lincoln Donovan

*Attorney, Agent, or Firm*—Larry I. Golden; Kareem M. Irfan

[57] ABSTRACT

A mid terminal for a double break circuit breaker comprises first and second elongated conductive plates, where each of the plates have first and second ends. The second end of the first plate is longitudinally spaced from the first end of the second plate and the first end of the first plate is connected to the second end of the second plate by a lateral conductive plate. A first are runner is electron beam welded to the second end of the first plate, and a second are runner is electron beam welded to the first end of the second plate. The first and second arc runners are preferably made of steel. A first stationary contact is mounted on the first plate adjacent the first arc runner, and a second stationary contact is mounted on the second plate adjacent the second arc runner. To manufacture the mid terminal, the first and second plates and the lateral plate are formed from a single strip of copper bent into a shape having a pair of longitudinal sections extending in opposite directions from opposing ends of a lateral section. The longitudinal sections correspond to the first and second plates, and the lateral section corresponds to the lateral plate.

16 Claims, 4 Drawing Sheets

MID TERMINAL FOR A DOUBLE BREAK CIRCUIT BREAKER

FIELD OF THE INVENTION

The present invention relates generally to circuit breakers and, more particularly, relates to a mid terminal for a double break circuit breaker.

BACKGROUND OF THE INVENTION

Use of circuit breakers is widespread in modern-day residential, commercial and industrial electric systems, and they constitute an indispensable component of such systems toward providing protection against over-current conditions. Various circuit breaker mechanisms have evolved and have been perfected over time on the basis of application-specific factors such as current capacity, response time, and the type of reset (manual or remote) function desired of the breaker.

One type of circuit breaker mechanism employs a thermo-magnetic tripping device to "trip" a latch in response to a specific range of over-current conditions. The tripping action is caused by a significant deflection in a bi-metal or thermostat-metal element which responds to changes in temperature due to resistance heating caused by flow of the circuit's electric current through the element. The thermostat-metal element is typically in the form of a blade and operates in conjunction with a latch so that blade deflection releases the latch after a time delay corresponding to a predetermined over-current threshold in order to "break" the current circuit associated therewith. Circuit breaker mechanisms of this type often include an electro-magnet operating upon a lever to release the breaker latch in the presence of a short circuit or very high current condition. A handle or push button mechanism is also provided for opening up the electric contacts to the requisite separation width and sufficiently fast to realize adequate current interruption.

Another type of circuit breaker, referred to as a "double-break" circuit breaker, includes two sets of current-breaking contacts to accommodate a higher level of over-current conditions than is accommodated by the one discussed above. One such double-break circuit breaker implements its two sets of contacts using the respective ends of an elongated rotatable blade as movable contacts which meet non-movable contacts disposed adjacent the non-movable contacts. The non-movable contacts are located on the ends of respective U-shaped stationary terminals, so that an electro-magnetic blow-off force ensues when the current, exceeding the threshold level, passes through the U-shaped terminals. Thus, when this high-level over-current condition is present, the blow:off force causes the elongated rotatable blade to rotate and the two sets of contacts to separate simultaneously.

Another type of double-break circuit breaker implements its two sets of contacts using separate and independent structures. For example, one set of contacts may be implemented using the previously-discussed thermo-magnetic tripping device to trip the current path at low-level current conditions, and the other set of contacts using an intricate and current-sensitive arrangement which separates its contacts in response to high-level blow-off current conditions. See, for example, U.S. Pat. Nos. 3,944,953, 3,96,346, 3,943,316 and 3,943,472, each of which is assigned to the instant assignee.

While providing adequate protection to high-level over-current conditions, such double-break circuit breakers are overly complex, and difficult to manufacture and service. With respect to their manufacture, for example, the complexity of the control mechanism for separating each set of contacts adds significantly to the overall component part count or the circuit breaker. Consequently, material and assembly costs for such circuit breakers are relatively high.

SUMMARY OF THE INVENTION

An object of the present invention is to provide a mid terminal for a double break circuit breaker which, in combination with other circuit breaker components, minimizes the amount of space employed in the circuit breaker and, at the same time, optimizes magnetic blow-off and interruption performance for the circuit breaker.

Another object of the present invention is to provide a method of making a mid terminal for a double break circuit breaker which minimizes the cost, time, and labor required to fabricate the mid terminal.

The foregoing objects are realized by providing a mid terminal for a double break circuit breaker, comprising first and second elongated conductive plates, each of the plates having first and second ends. The second end of the first plate is longitudinally spaced from the first end of the second plate and the first end of the first plate is connected to the second end of the second plate by a lateral conductive plate. A first arc runner is connected to the second end of the first plate, and a second arc runner is connected to the first end of the second plate. A first stationary contact is mounted on the first plate adjacent the first arc runner, and a second stationary contact is mounted on the second plate adjacent the second arc runner.

In addition, the foregoing objects are realized by providing a method of making a mid terminal for a double break circuit breaker, the mid terminal including a pair of arc runners and a pair of stationary contacts, the method comprising the steps of generating a strip of conductive material having first and second ends; connecting the arc runners to the respective first and second ends of the strip; forming the strip into a shape having a pair of longitudinal sections bridged by a lateral section, the longitudinal sections extending in opposite directions from opposing ends of the lateral section, one of the longitudinal sections including the first end of the strip and the other of the longitudinal sections including the second end of the strip; and mounting the stationary contacts on the respective longitudinal sections adjacent the respective arc runners.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

Figure 1A:
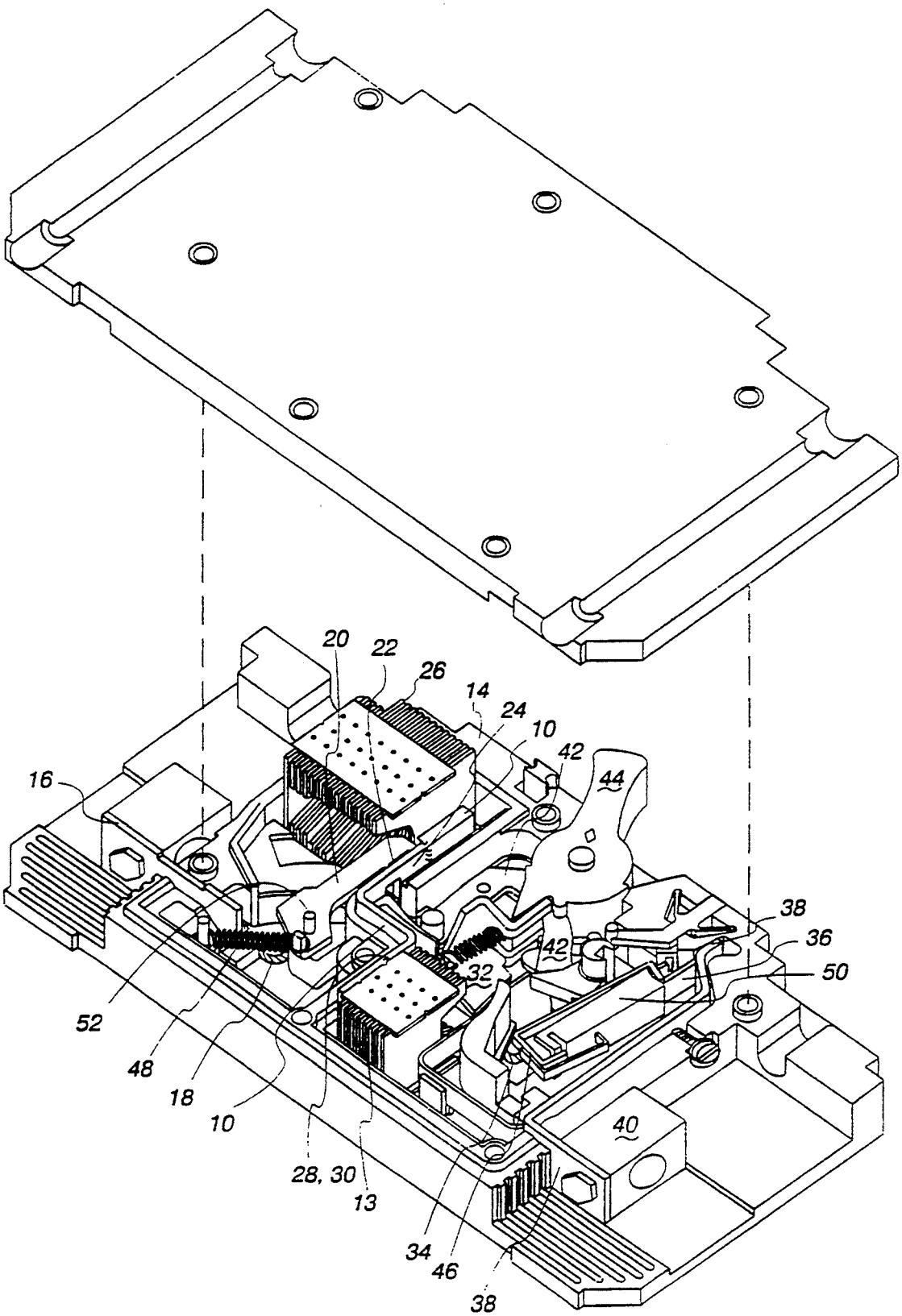
FIGS. 1*a* and 1*b* are perspective and side views, respectively, of a series double breaker circuit breaker including a mid terminal embodying the present invention.

While the invention is susceptible to various modifications and alternative forms, a specific embodiment thereof has been shown by way of example in the drawings and will be described in detail. It should be understood, however, that it is not intended to limit the invention to the particular form described. On the contrary, the intention is to cover all modifications, equivalents and alternatives falling within the spirit and scope of the invention as defined by the appended claims.

DESCRIPTION OF THE PREFERRED EMBODIMENTS

Figure 1B:
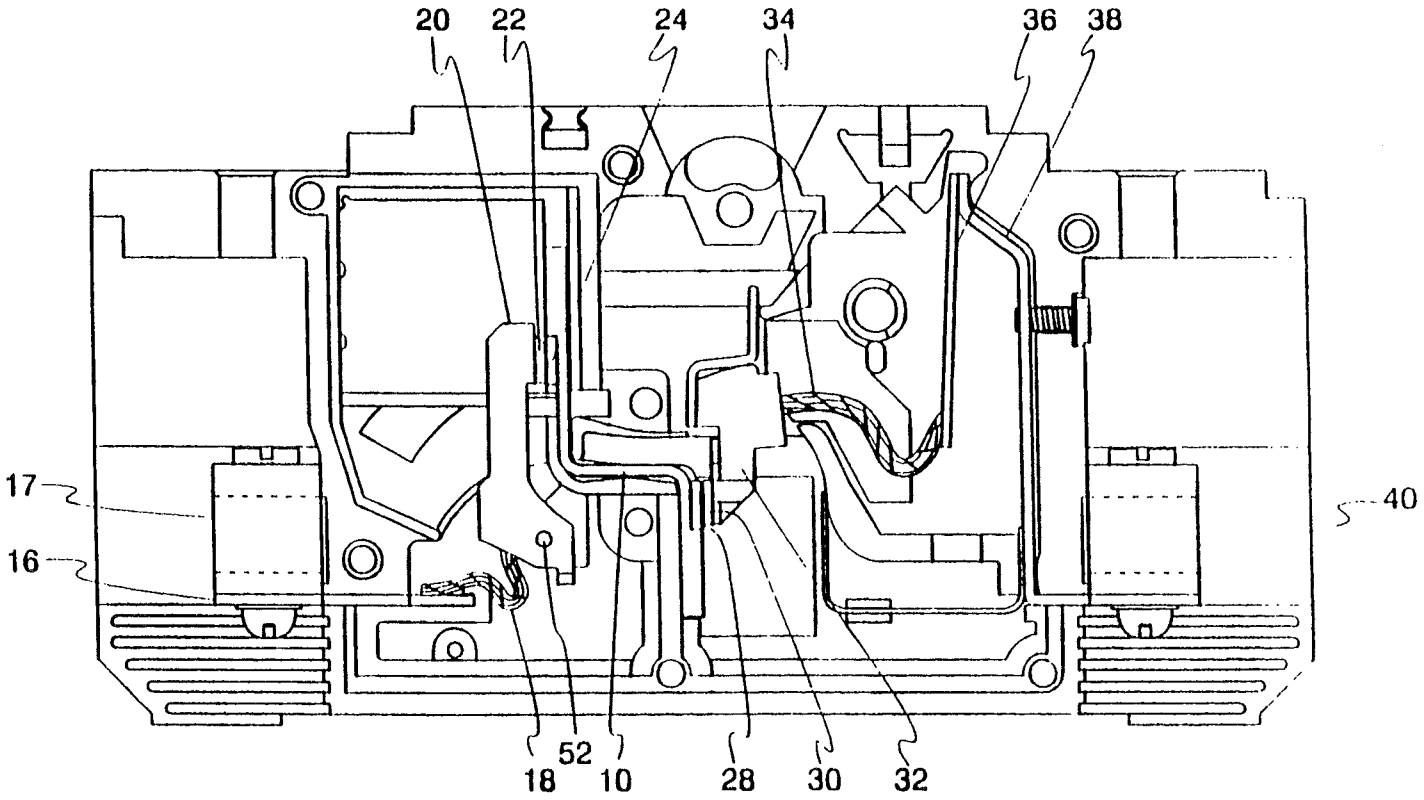

Turning now to the drawings, FIGS. 1*a* and 1*b* illustrate a series double breaker circuit breaker having a mid terminal 10 embodying the principles of the present invention. The mid terminal 10 will be described in detail below following a brief description of the overall operation of the exemplary double-break circuit breaker.

The circuit breaker includes a circuit breaker base 14 which carries all of the internal components of the circuit breaker. The current path through the circuit breaker begins at a line terminal 16, and from the line terminal 16 the current path goes through a flexible pigtail 18. The flexible pigtail 18 is attached to a secondary blade 20 with a moveable contact 22 mating with a stationary contact 24. Current flows through the moveable and stationary contacts 22, 24 to the mid terminal 10, which is configured in an S form. The other side of the mid terminal 10 includes another stationary contact 28 connected thereto. Positioned opposite the stationary contact 28 is a mating moveable contact 30 attached to a primary blade 32. Current flows through the stationary and moveable contacts 28, 30, through the primary blade 32, and into one end of a primary flexible connector or pigtail 34. The other end of the primary flexible connector 34 is attached to a bimetal 36, which provides the thermal tripping characteristics for the circuit breaker. Finally, the current flows from the bimetal 36 through a load terminal 38 and out of the load end of the circuit breaker via a lug 40.

The primary section of the circuit breaker includes the primary blade 32, a trip lever 42, a handle 44, a magnetic armature 46, a pigtail 34, and a primary arc stack 13. The secondary section includes the secondary blade 20, the pigtail 18, an extension spring 48, and the secondary arc stack 26. In the illustrated circuit breaker, using conventional magnetic and thermal trip protection features, the primary section provides the breaking capacity for all levels of current from one ampere to approximately 3000 amperes without operational assistance from the secondary section. The magnetic armature 46 is drawn to a yoke 50 during high current flow. This allows the trip lever 42 to disengage from the magnetic armature 46 and rotate to the trip position, which, in turn, allows the primary blade contact 30 to separate from the stationary contact 28 to break the current flow. As the contacts 28, 30 are separated, an arc voltage is generated in the primary arc stack 13. A thermal trip via the bimetal 36 results in the same sequence of events and, additionally, results in the trip lever 42 disengaging from the magnetic armature 46.

The normal ON and OFF operation of the primary blade 32 occurs in response to rotation of the handle 44 in a clockwise or counterclockwise motion. In response to rotation of the handle 44 in either direction, the primary blade 32 either opens or closes the circuit via the primary moveable contact 30 and the primary stationary contact 28. Rotation of the primary blade 32 is tied directly to the handle 44 for the normal ON and OFF operation of the primary blade 32. Furthermore, the secondary section is not affected by the normal ON and OFF operation of the primary blade 32. The secondary blade contact 22 and the secondary stationary contact 24 remain closed.

As previously explained, the secondary section of the circuit breaker has limited operation below 3000 amperes of fault current. However, at current levels above 3000 amperes, the secondary section begins to contribute to interruption performance. In particular, the secondary blade 20 derives contact force from the extension spring 48. The secondary blade 20 pivots about the blade pivot 52 with the extension spring 48 extended as the secondary blade 20 opens up in response to a current fault above 3000 amperes. There is no linkage of the secondary blade 20 to the primary blade 32, but rather the operation of the secondary and primary blades 20, 32 is totally separate and independent.

In response to the occurrence of a current fault above 3000 amperes, the constriction resistance of the secondary blade contact 22 and the secondary stationary contact 24 provides a magnetic force that tries to separate the contacts. Simultaneously, the current path configuration of the mid terminal 10 and the secondary blade 20 forms a magnetic blowoff loop which also tries to separate the contacts 22, 24. The addition of both of these opening forces to the secondary blade 20 causes the secondary blade 20 to separate at the contacts 22, 24. As the secondary blade 20 opens, the extension spring 48 begins to stretch. The extension spring 48 permits the secondary blade 20 to continue to open as long as the force to open the blade is greater than the extension force of the spring 48. As the contacts 22, 24 are separated, an arc voltage is generated in the secondary arc stack 26. The combination of the arc voltage generated by the secondary arc stack 26 and the arc voltage generated by the primary arc stack 13 make these voltages add together. This allows a very fast rise of arc voltage and also allows high levels of arc voltage consistent with double break circuit breakers.

As the current fault level rises significantly above 3000 amperes, the faster and higher the secondary blade 20 will be moved. As the interruption takes place and the electric arc is extinguished in the primary and secondary sections, the secondary blade 20 is biased to return to the closed position because of the spring bias from the extension spring 48. The primary blade remains in the open or tripped position. At this point, the interruption of the current fault is complete with no opportunity to reestablish itself.

As described above, the mid terminal 10 serves as a common connection point between the primary blade 32 and the secondary blade 20. From the primary blade 32, the current path through the circuit breaker passes through the flexible connector 34, through the bimetal 36, and finally out the load terminal 38. From the secondary blade 20, the current path passes through the flexible connector 18 and out the line terminal 16.

Figure 2:
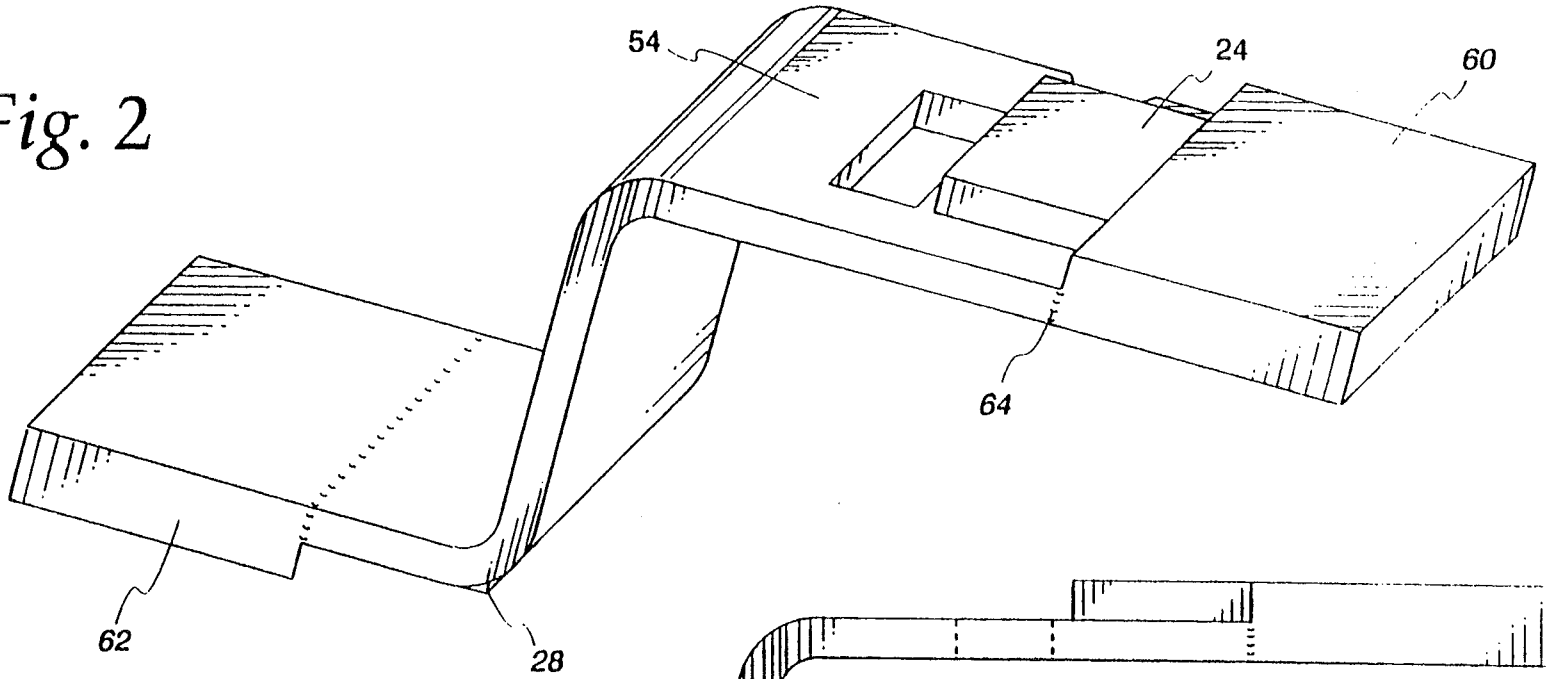
FIG. 2 is a perspective view of a mid terminal embodying the present invention and which can be used in the circuit breaker of FIG. 1*a* and 1*b*.

For further information regarding the overall construction and operation of the circuit breaker shown in FIG. 2, reference may be made to U.S. patent application Ser. No. 08/181,289, entitled "Circuit Breaker Having Double Break Mechanism", filed concurrently herewith, assigned to the instant assignee and incorporated herein by reference.

Figure 3:
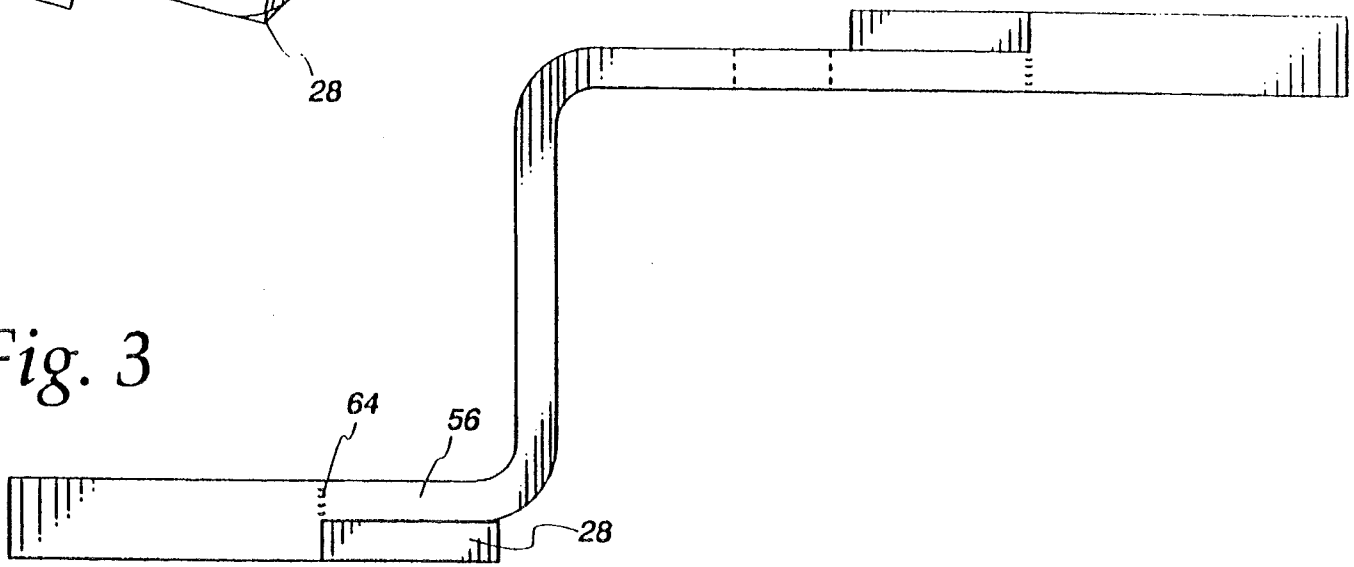
FIG. 3 is a side view of the mid terminal in FIG. 2.

FIGS. 2 and 3 illustrate a more detailed view of the mid terminal 10 embodying the present invention. The mid terminal 10 is configured in an S-shape having a pair of parallel longitudinal plates 54, 56 bridged by a lateral plate 58. As shown in FIG. 2, the plate 54 is approximately twice as long as the plate 56, and the lateral plate 58 is positioned orthogonal to the plates 54, 56. One of the opposing ends of the lateral plate 58 is integrally connected to one of the ends of the plate 54, while the other of the opposing ends of the lateral plate 58 is integrally connected to one of the ends of the plate 56. The longitudinal plates 54, 56 have the same thickness as the lateral plate 58. This thickness is selected to be relatively large so as to impart robustness to the mid terminal 10 which, in turn, provides the mid terminal 10 with a relatively low resistance and therefore a relatively low watts loss to the circuit breaker.

Arc runners 60, 62 are longitudinally positioned and attached adjacent the other ends of the respective plates 54, 56. The arc runners 60, 62 have a thickness slightly greater than the thickness of the respective plates 54, 56. The stationary contacts 24, 28 are positioned adjacent the respective arc runners 60, 62 and mounted to the outer surfaces of the respective plates 54, 56. The mid terminal 10 is positioned within the base 14 of the circuit breaker in FIGS. 1*a* and 1*b* so that the secondary blade contact 22 mates with the stationary contact 24, and the primary blade contact 30 mates with the stationary contact 28. The combined thickness of the respective plates 54, 56 and the contacts 24, 28 mounted thereto is approximately the same as the thickness of the respective arc runners 60, 62.

The S-configuration of the mid terminal 10 provides a design that requires a minimal amount of space in the circuit breaker base 14, and yet allows optimal magnetic blowoff configurations for both the secondary blade 20 and the primary blade 32 relative to the mid terminal 10. The magnetic blowoff loop showing the interaction between the secondary blade 20 and the mid terminal 10 runs from the body of the secondary blade 20, through the moveable contact 22 and the stationary contact 24, and through the longitudinal plate 54. Similarly, the magnetic blowoff loop showing the interaction between the primary blade 32 and the mid terminal 10 runs from the longitudinal plate 58, through the stationary contact 28 and the moveable contact 30, and through the body of the primary blade 32. Thus, by employing the S-configuration for the mid terminal 10, the magnetic blowoff and interruption generated by these blowoff loops is optimized and, at the same time, the available space in the base 14 for the mid terminal 10 and adjacently-located arc stacks 13, 26 is optimally used.

To manufacture the mid terminal 10, a strip of conductive material is stamped out of a piece of rawstock. Next, the arc runners 60, 62 are electron beam welded to the opposite ends of the strip to form electron beam interfaces 64 between the strip and the arc runners 60, 62. In the preferred embodiment, the strip is made of copper while the are runners 60, 62 are made of steel. After attaching the arc runners 60, 62 to the strip, two right-angled bends are imparted to the strip to form a structure having two longitudinal sections extending in opposite directions from opposing ends of a lateral section. These longitudinal sections correspond to the longitudinal plates 54, 56 and the lateral section corresponds to the lateral plate 58. Finally, the stationary contacts 24, 28 are mounted to the respective longitudinal plates 54, 56 adjacent the respective arc runners 60, 62. The foregoing fabrication process minimizes the cost, time, and labor required to fabricate the mid terminal 10.

Figure 4:
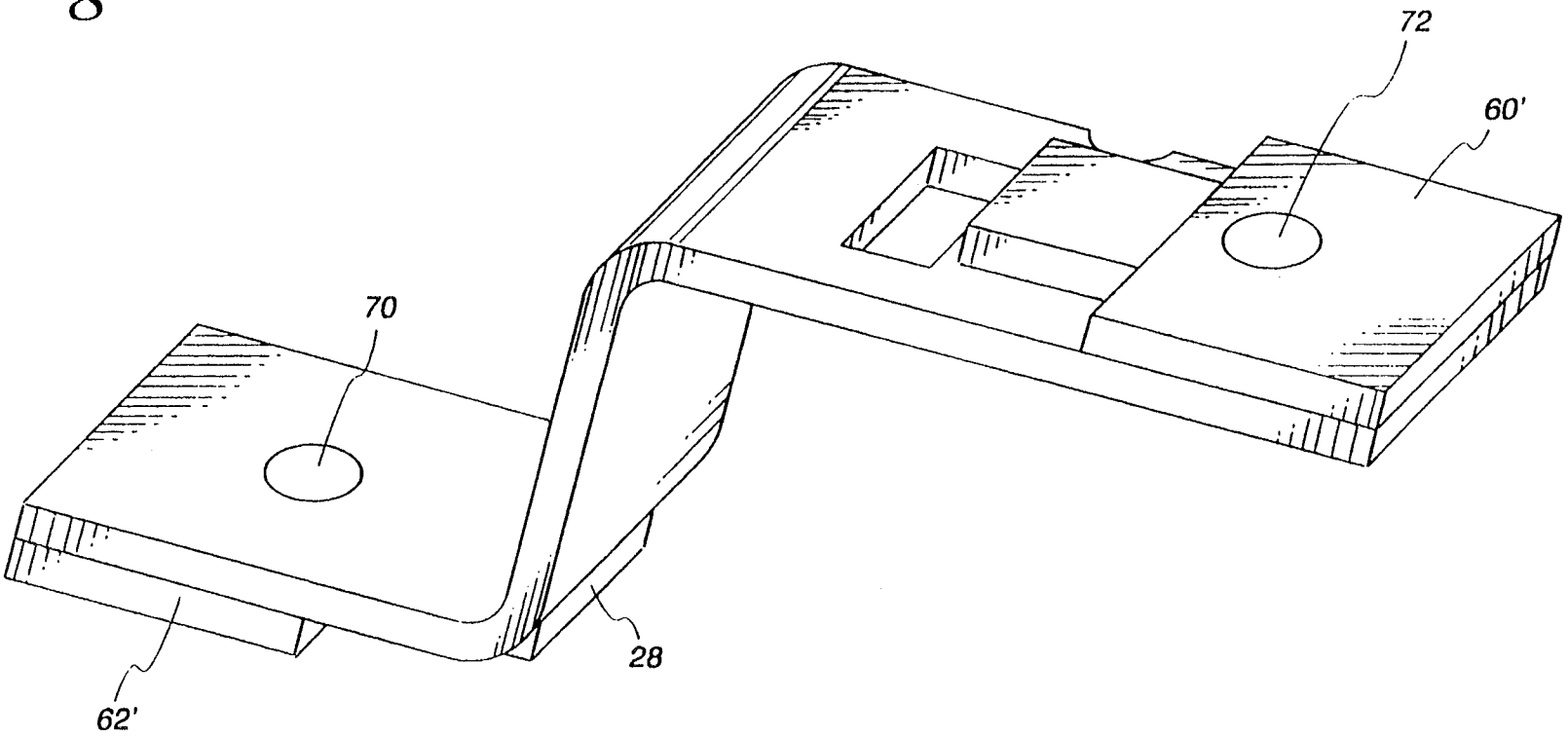
FIG. 4 is a perspective view of an alternative mid terminal embodying the present invention and which also can be used in the circuit breaker of FIG. 1*a* and 1*b*.

In an alternative fabrication process and as illustrated in FIG. 4, arc runners 60′, 62′ which are thinner than the arc runners 60, 62 are stamped out, cleaned, plated, and then attached by means such as rivets 70, 72 or welding to opposite surfaces of the strip at opposite ends. If rivets 70, 72 are used to attach the arc runners to the strip, the strip is provided with holes for receiving the rivets. Since the arc runners 60′, 62′ are attached to the surfaces of the strip, as opposed to the lateral ends of the strip, the stamped-out strip in this alternative fabrication process is longer than the strip in the previously described fabrication process.

Those skilled in the an will readily recognize that various modifications and changes may be made to the present invention without departing from the true spirit and scope thereof, which is set forth in the following claims.

What is claimed is:

1. A mid terminal for a double break circuit breaker, comprising:

a unitary conductive strip having first and second ends, said conductive strip including a pair of generally parallel, straight longitudinal sections bridged by a lateral section, said longitudinal sections extending in opposite directions from respective opposing ends of said lateral section, one of said pair of longitudinal sections including said first end of said conductive strip and the other of said pair of longitudinal sections including said second end of said conductive strip a first arc runner connected to said first end of said conductive strip;

a second arc runner connected to said second end of said conductive strip;

a first stationary contact mounted on said one of said pair of longitudinal sections adjacent said first arc runner; and a second stationary contact mounted on said other of said pair of longitudinal sections adjacent said second arc runner.

2. The mid terminal of claim 1, wherein said first arc runner is mounted and rivetted on said end of said conductive strip, and said second arc runner is mounted and rivetted on said second end of said conductive strip.

3. The mid terminal of claim 1, wherein said first arc runner is electron beam welded to said first end of said conductive strip, and said second are runner is electron beam welded to said second end of said conductive strip.

4. The mid terminal of claim 1, wherein said conductive strip is composed of copper.

5. The mid terminal of claim 4 wherein said first and second arc runners are composed of steel.

6. A method of making a mid terminal for a double break circuit breaker, the mid terminal including a pair of arc runners and a pair of stationary contacts, the method comprising the steps of:

generating a unitary strip of conductive material having first and second ends;

connecting the arc runners to the respective first and second ends of the strip;

forming the strip into a shape having a pair of generally parallel, straight longitudinal sections bridged by a lateral section, the longitudinal sections extending in opposite directions from respective opposing ends of the lateral section, one of the longitudinal sections including the first end of the strip and the other of the longitudinal sections including the second end of the strip; and mounting the stationary contacts on the respective longitudinal sections adjacent the respective arc runners.

7. The method of claim 6, wherein said step of generating a unitary strip of conductive material includes the step of stamping the strip out of a piece of rawstock.

8. The method of claim 6, wherein said step of connecting the arc runners to the respective first and second ends of the strip includes the step of electron beam welding the are runners to the respective first and second ends of the strip.

9. The method of claim 6 wherein the conductive material for generating the strip is composed of copper.

10. The method of claim 6 wherein the arc runners are composed of steel.

11. A mid terminal and contact blade arrangement for a double break circuit breaker, comprising:

a unitary conductive strip having first and second ends, said conductive strip including a pair of generally parallel, straight longitudinal sections bridged by a lateral section, said longitudinal sections extending in opposite directions from respective opposing ends of said lateral section, one of said pair of longitudinal sections including said first end of said conductive strip and the other of said pair of longitudinal sections including said second end of said conductive strip;

a first stationary contact mounted on said one of said pair of longitudinal sections;

a second stationary contact mounted on said other of said pair of longitudinal sections;

a first contact blade rotatable between a closed position and an open position, said first blade having a first movable contact mounted thereto, said first movable contact abutting said first stationary contact while said first blade is disposed in said closed position, said first blade projecting over said conductive strip generally between said first and second ends of said conductive strip; and a second contact blade rotatable between a closed position and an open position, said second blade having a second movable contact mounted thereto, said second movable contact abutting said second stationary contact while said second blade is disposed in said closed position, said second blade projecting over said conductive strip generally between said first and second ends of said conductive strip.

12. The arrangement of claim 11, further including a first arc runner connected to said first end of said conductive strip adjacent said first stationary contact, and a second are runner connected to said second end of said conductive strip adjacent said second stationary contact.

13. The mid terminal of claim 12, wherein said first arc runner is mounted and rivetted on said first end of said conductive strip, and said second arc runner is mounted and rivetted on said second end of said conductive strip.

14. The mid terminal of claim 12, wherein said first arc runner is electron beam welded to said first end of said conductive strip, and said second arc runner is electron beam welded to said second end of said conductive strip.

15. The mid terminal of claim 11, wherein said conductive strip is composed of copper.

16. The mid terminal of claim 12, wherein said first and second arc runners are composed of steel.

* * * * *